US008975882B2

(12) United States Patent
Li

(10) Patent No.: US 8,975,882 B2
(45) Date of Patent: Mar. 10, 2015

(54) REGULATOR WITH IMPROVED WAKE-UP TIME

(71) Applicant: Taiwan Semiconductor Manufacturing Co., Ltd., Hsin-Chu (TW)

(72) Inventor: Chih-Feng Li, Zhubei (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 203 days.

(21) Appl. No.: 13/664,484

(22) Filed: Oct. 31, 2012

(65) Prior Publication Data

US 2014/0117952 A1 May 1, 2014

(51) Int. Cl.

| | |
|---|---|
| ***G05F 1/00*** | (2006.01) |
| ***G05F 3/04*** | (2006.01) |
| ***G05F 3/08*** | (2006.01) |
| ***H02H 7/00*** | (2006.01) |
| ***G05F 1/565*** | (2006.01) |

(52) U.S. Cl.
CPC ..... *G05F 1/565* (2013.01)
USPC ..... 323/274; 323/280; 323/284; 323/311; 323/312; 361/18

(58) Field of Classification Search
USPC ..... 323/274, 280, 284, 311, 312; 361/18
See application file for complete search history.

(56) References Cited

U.S. PATENT DOCUMENTS

| | | | | |
|---|---|---|---|---|
| 5,966,004 | A * | 10/1999 | Kadanka | 323/271 |
| 6,201,375 | B1 * | 3/2001 | Larson et al. | 323/277 |
| 6,333,623 | B1 * | 12/2001 | Heisley et al. | 323/280 |
| 6,969,976 | B1 * | 11/2005 | Broach et al. | 323/222 |
| 7,221,213 | B2 * | 5/2007 | Lee et al. | 327/541 |
| 7,714,553 | B2 * | 5/2010 | Lou | 323/276 |
| 2002/0014882 | A1 * | 2/2002 | Hsu | 323/274 |
| 2007/0108950 | A1 * | 5/2007 | Kakinuma | 323/280 |
| 2008/0094045 | A1 * | 4/2008 | Lin | 323/274 |
| 2008/0180079 | A1 * | 7/2008 | Kurozo et al. | 323/284 |
| 2010/0156367 | A1 * | 6/2010 | Takagi | 323/282 |

(Continued)

OTHER PUBLICATIONS

Maity, B. et al., "Fast Transient Frequency Control Voltage Regulator Using Push Dynamic Leaker Circuit", 2010 India International Conference on Power Electronics (IICPE), Jan. 2011, pp. 1-6.

MPS® The Future of Analog IC Technology, MP6401, 300 mA LDO Linear Regulator with Integrated Circuit, 2012, pp. 1-16, www.MonolithicPower.com.

(Continued)

*Primary Examiner* — Adolf Berhane
*Assistant Examiner* — Gary Nash
(74) *Attorney, Agent, or Firm* — Duane Morris LLP

(57) ABSTRACT

A regulating circuit includes a first comparator configured to control a turning on and a turning off of a first transistor based on a first comparison a reference voltage to a feedback voltage. The first transistor is coupled between an output node and a first voltage supply. A second comparator is configured to control a turning on and a turning off of a second transistor based on a second comparison of the reference voltage to the feedback voltage. The second transistor is coupled to the output node. A high-impedance circuit is coupled in series with the second transistor such that the high-impedance block is disposed between the second transistor and a second power supply. The high-impedance circuit is configured to generate a constant current between the output node and the second voltage supply when the second transistor is turned on.

15 Claims, 5 Drawing Sheets

(56) References Cited

U.S. PATENT DOCUMENTS

2010/0277148 A1* 11/2010 Zhao et al. ..... 323/282
2011/0121802 A1* 5/2011 Zhu ..... 323/281

OTHER PUBLICATIONS

Microchip-MCP1702, 250 mA Low Quiescent Current LDO Regulator, 2010 Microchip Technology, Inc., DS2208E—pp.1-26.

* cited by examiner

REGULATOR WITH IMPROVED WAKE-UP TIME

FIELD OF DISCLOSURE

The disclosed circuits and method relate to integrated circuits. More particularly, the disclosed circuits and methods relate to integrated circuits including regulators with improved wake-up time.

BACKGROUND

Voltage regulators are widely used circuits that are designed to output a substantially constant voltage level. For example, voltage regulators are used in computers, mobile telephones, laptop and tablet computers, and power supplies to list but only a few examples. Conventional voltage regulators suffer from lengthy wake-up times as the output voltage of the voltage regulator settles to a desired voltage level. Additionally, conventional voltage regulators suffer from varied operating conditions as a result of process, temperature, and voltage variations.

DETAILED DESCRIPTION

This description of the exemplary embodiments is intended to be read in connection with the accompanying drawings, which are to be considered part of the entire written description.

The disclosed regulator circuits including high-impedance blocks disclosed herein advantageously have reduced wake-up times and power consumption. Additionally, the regulator circuits provide for reduced process, voltage, and temperature ("PVT") variations. As described in greater detail below, the high-impedance block of the disclosed regulator circuit achieves these improves by providing a constant current for pulling down the output voltage of the regulator to the desired regulated voltage level.

Figure 1:
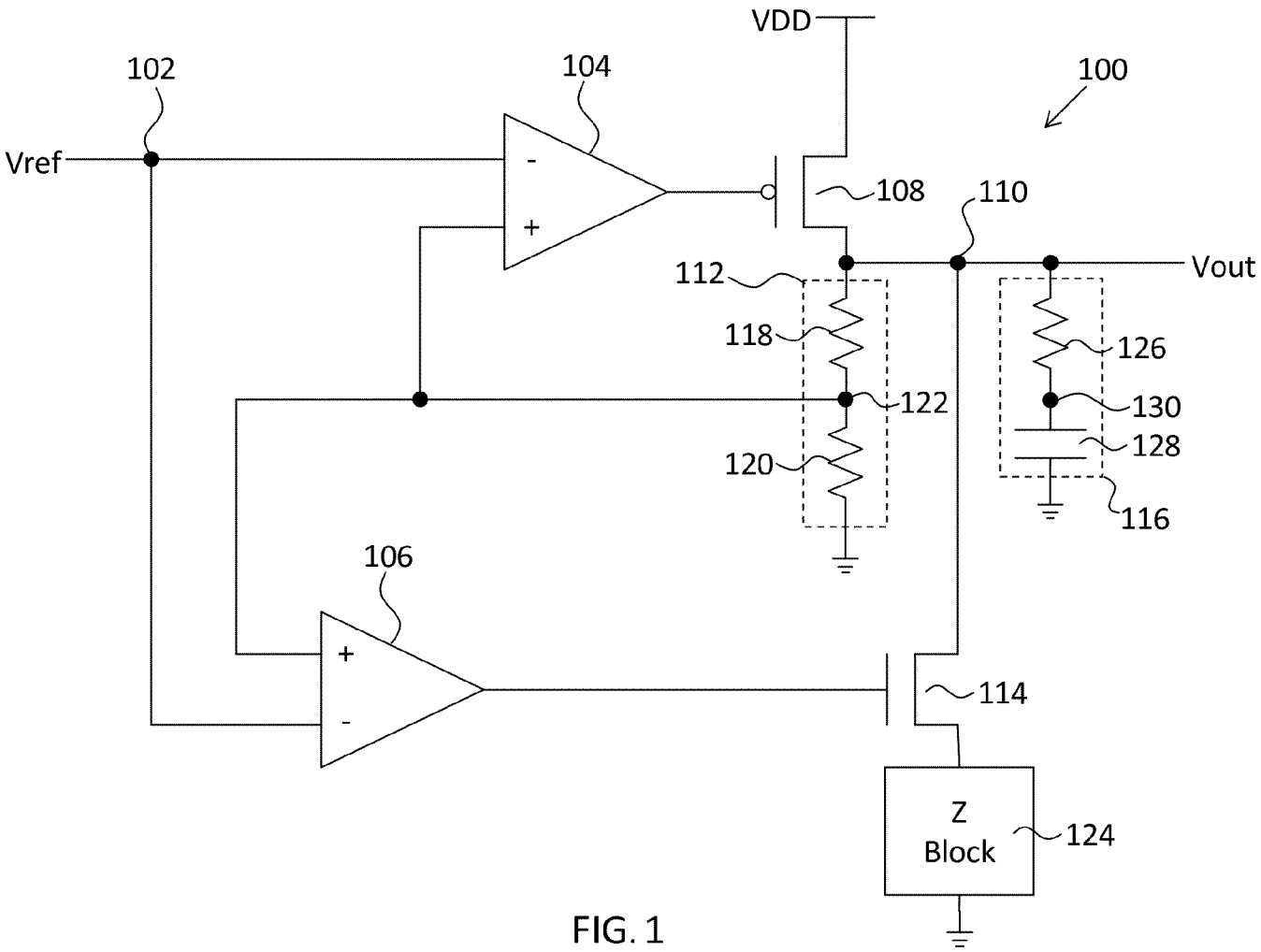
FIG. 1 illustrates one example of a regulator comprising a high-impedance block in accordance with some embodiments.

FIG. 1 illustrates one example of a push-pull low-dropout ("LDO") regulator 100 in accordance with some embodiments. As shown in FIG. 1, LDO regulator 100 includes a node 102 configured to receive a reference voltage, Vref. Node 102 is coupled to an input of a first operational amplifier ("op amp") 104 and to the input of a second op amp 106. In some embodiments, node 102 is coupled to the negative terminal of op amp 104 and is coupled to the negative terminal of op amp 106.

The output of op amp 104 is coupled to the gate of transistor 108, which has its source coupled to voltage supply VDD and its drain coupled to node 110. In some embodiments, transistor 108 is a PMOS transistor, although one of ordinary skill in the art will understand that transistor 108 can be implemented as an NMOS transistor. Node 110 serves as the output node of regulator 100 and is coupled to a resistor string 112, to a transistor 114, and to an RC circuit 116. Resistor string 112 is coupled between node 110 and ground and includes first and second resistors 118, 120 that are coupled together at node 122.

Node 122 is coupled to a second input of op amp 106, which has its output coupled to the gate of transistor 114. In some embodiments, transistor 114 is implemented as an NMOS transistor, although one of ordinary skill in the art will understand that transistor 114 can be implemented as another transistor type. The drain of transistor 114 is coupled node 110, and the source of transistor 114 is coupled to a high-impedance circuit block 124 that advantageously speeds up that wake-up of regulator 100 as described in greater detail below.

RC circuit 116 includes a resistor 126 and a capacitor 128 coupled together in series with each other. In some embodiments, capacitor 128 is coupled between ground and node 130, and resistor 126 is coupled between node 110 and node 130. However, one of ordinary skill in the art will understand that RC circuit 116 can have other configurations.

Figure 2:
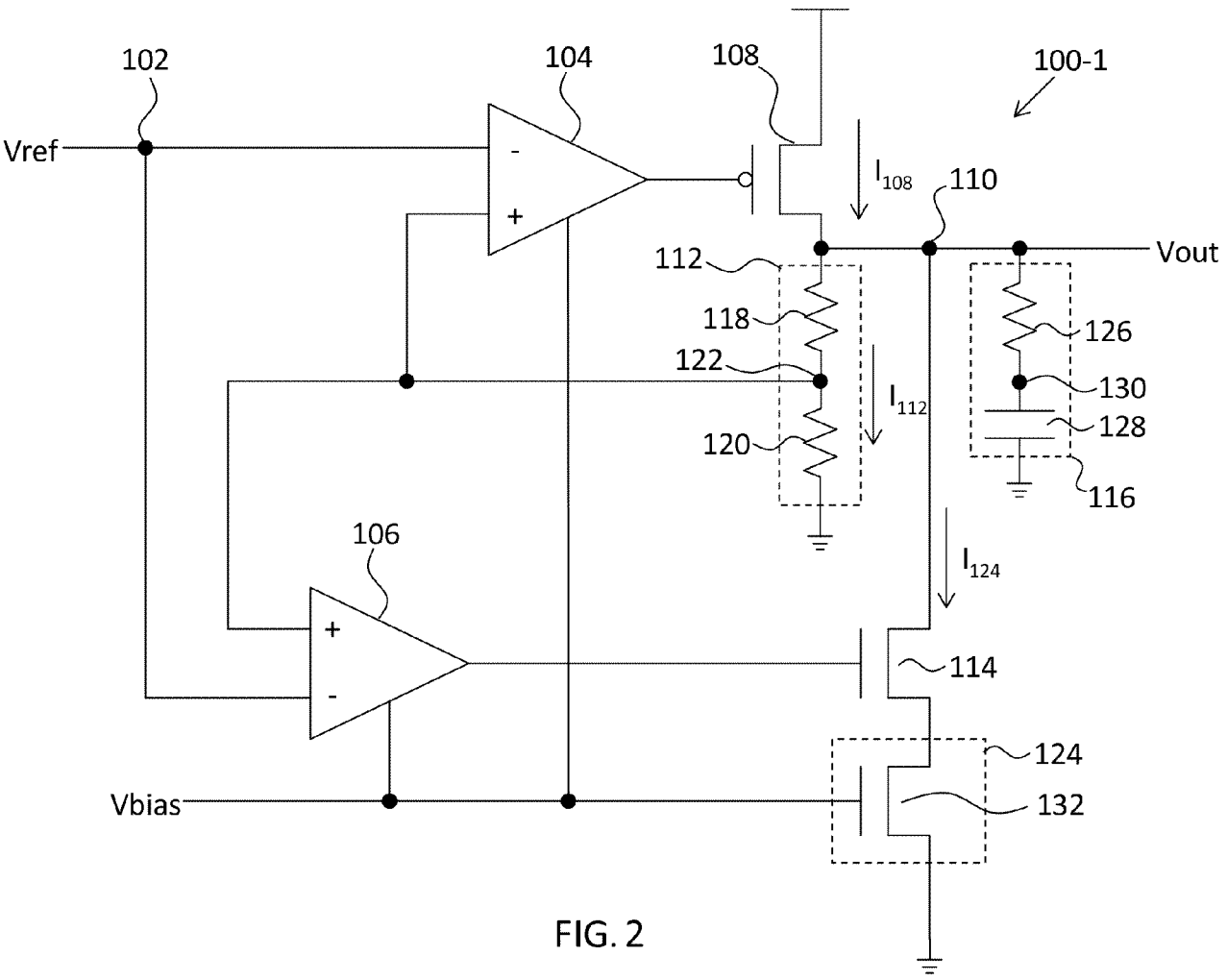
FIG. 2 illustrates another example of a regulator comprising a high-impedance block including a transistor in accordance with some embodiments.

FIG. 2 illustrates another example of an LDO regulator 100-1 in which high-impedance circuit block is implemented as a transistor 132. As shown in FIG. 2, LDO regulator 100-1 includes node 102 configured to receive a reference voltage, Vref. Node 102 is coupled to the negative input of op amp 104 and to the positive input of op amp 106.

The output of op amp 104 is coupled to the gate of transistor 108, which has its source coupled to voltage supply VDD and its drain coupled to output node 110. Resistor string 112, transistor 114, and RC circuit 116 are also coupled to output node 110. Resistor string 112 is coupled between output node 110 and ground and includes first and second resistors 118, 120 that are coupled together at node 122.

Node 122 is coupled to the positive terminal of op amp 106, which has its output coupled to the gate of transistor 114. The drain of transistor 114 is coupled node 110, and the source of transistor 114 is coupled to the drain of transistor 132 of high-impedance block 124. Transistor 132, which in some embodiments is implemented as an NMOS transistor, has its source coupled to ground and its gate configured to receive a bias voltage, Vbias. In some embodiments, the bias voltage, Vbias, is also provided to op amps 104 and 106.

RC circuit 116 includes a resistor 126 and a capacitor 128 coupled together in series with each other. In some embodiments, capacitor 128 is coupled between ground and node 130, and resistor 126 is coupled between node 110 and node 130. However, one of ordinary skill in the art will understand that RC circuit 116 can have other configurations.

Figure 3:
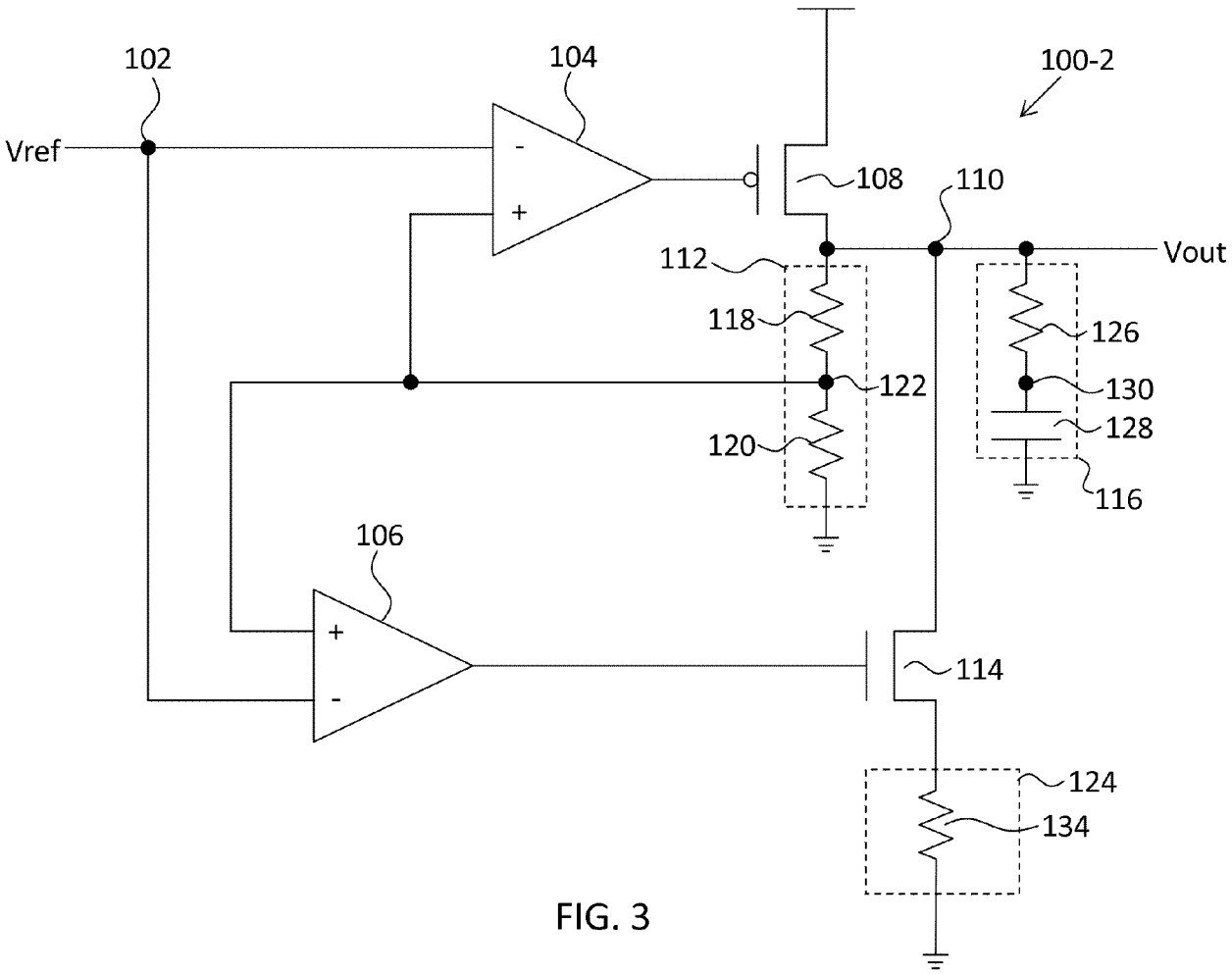
FIG. 3 illustrates another example of a regulator comprising a high-impedance block including a resistor in accordance with some embodiments.

FIG. 3 illustrates another example of an LDO regulator 100-2 in which high-impedance block 124 includes a resistor in accordance with some embodiments. As shown in FIG. 3, node 102 of regulator 100-2 is configured to receive a reference voltage, Vref, and is coupled to the negative input of op amp 104 and to the positive input of op amp 106.

The output of op amp 104 is coupled to the gate of transistor 108. The source of transistor 108 is coupled to voltage supply VDD, and the drain of transistor 108 is coupled to output node 110. Resistor string 112, transistor 114, and RC circuit 116 are also coupled to output node 110. Resistor string 112 is coupled between output node 110 and ground. In some embodiments resistor string 112 includes a pair of resistors 118, 120 that are coupled together at node 122; however, one of ordinary skill in the art will understand that resistor string 112 can include more than two resistors.

The positive terminal of op amp 106 is coupled to node 122, and the output of op amp 106 is coupled to the gate of transistor 114. The drain of transistor 114 is coupled node 110, and the source of transistor 114 is coupled to resistor 134 of high-impedance block 124. Resistor 134 is coupled to ground and to the source of transistor 114 and advantageously increases the speed at which LDO regulator 100-2 wakes up as described in greater detail below.

RC circuit 116 includes a resistor 126 and a capacitor 128 coupled together in series with each other. In some embodiments, capacitor 128 is coupled between ground and node 130, and resistor 126 is coupled between node 110 and node 130. One of ordinary skill in the art will understand that RC circuit 116 can have other configurations.

Figure 4:
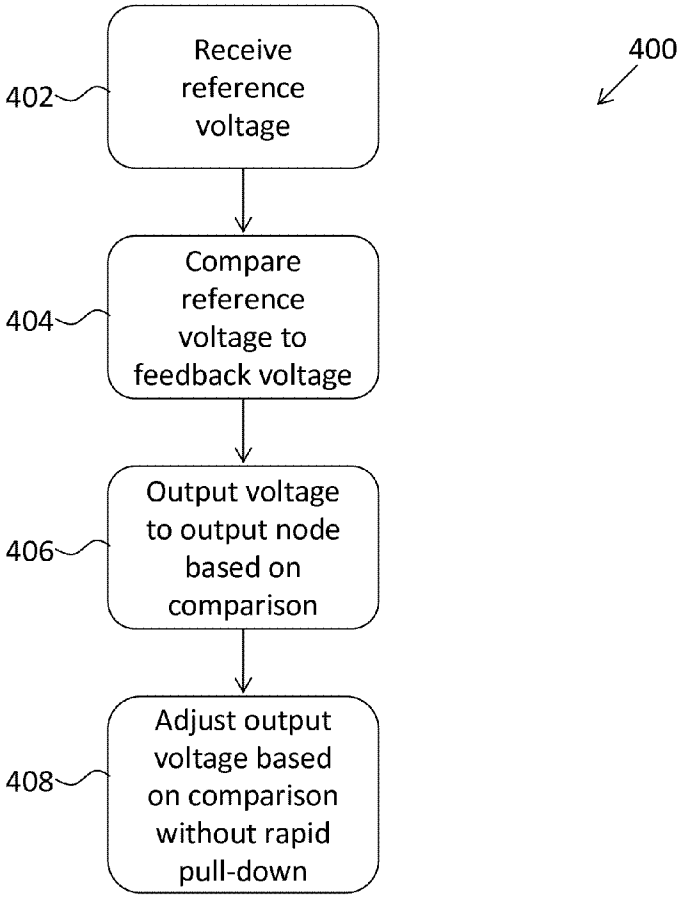
FIG. 4 is a flow diagram of one example of a method of operation in accordance with some embodiments.

The operation of a regulator circuit configured with a high-impedance block for improved wake-up time is described with reference to FIG. 4, which is a flow diagram of one example of a method 400 of operation. At block 402, a reference voltage is received by regulator 100. Reference voltage, Vref, can be provided by a bandgap reference circuit and is received at node 102, which is coupled to an input of op amp 104 and to an input of op amp 106.

At block 404, the reference voltage is compared to a feedback voltage. As shown in FIGS. 1, 2, and 3, a feedback voltage, e.g., the voltage at node 122, $V_{122}$, is received at an input of op amp 104 and at an input of op amp 106. Op amp 104 compares the feedback voltage, $V_{122}$, to reference voltage Vref, and op amp 106 compares voltage $V_{122}$ to reference voltage Vref.

At block 406, a voltage is output to output node based on the comparison of the feedback voltage $V_{122}$ and the reference voltage. Referring again to FIGS. 1, 2, and 3, op amp 104 outputs a voltage to the gate of transistor 108 based on the comparison of reference voltage Vref and feedback voltage $V_{122}$. The voltage received at the gate of transistor 108 turns one or off transistor 108, which adjusts the voltage at output node 110.

For example, if the voltage output by op amp 104 is at or close to zero such that the voltage applied to the gate of transistor 108 is greater than the threshold voltage of transistor 108, e.g., $Vth_{108}$, then transistor 108 is turned on such that current flows through transistor 108 and pulls the voltage at node 110, e.g., $V_{110}$, up towards the voltage level of VDD. If the voltage output by op amp 104 is greater than zero such that the gate source voltage is less than the threshold voltage, then transistor 108 is turned off such that current does not flow through transistor 108. One of ordinary skill in the art will understand that transistor 108 can be "more on" and "more off" depending on the difference between the gate-source voltage and the threshold voltage of transistor 108 such that some current may still flow through transistor 108 if transistor 108 is less off, e.g., the difference between the threshold voltage and the gate-source voltage is small.

At block 408, the voltage at the output node is adjusted based on the comparison of the feedback voltage $V_{122}$ to the reference voltage Vref. For example, op amp 106 receives the feedback voltage V122, which is based on the output voltage, and the reference voltage Vref and outputs a voltage to the gate of transistor 114. The turning on and off of transistor 114 is controlled by the voltage output by op amp 106. If, for example, the voltage output by op amp 106 is low such that the gate-source voltage of transistor 114 is less than the threshold voltage of transistor 114, then transistor 114 is in an off state such that current does not flow through transistor 114. If the voltage output by op amp 106 is high such that the gate-source voltage of transistor 114 is greater than the threshold voltage, then transistor 114 turns on enabling current to flow through transistor 114. When transistor 114 is on and current flows through transistor 114, the voltage at node 110 to be pulled down towards ground potential.

The high-impedance block 124 coupled in series with transistor 114 advantageously provides improved wake-up time for regulators and a lower power consumption by providing a constant current for pulling down the voltage at output node 110. Pulling down the voltage at node 110 when transistor 114 is turned on with a constant current prevents rapid pull-down that increases power consumption and increases the likelihood of overshooting the desired regulated voltage level, which increases the wake-up or settling time of a regulator.

Figure 5A:
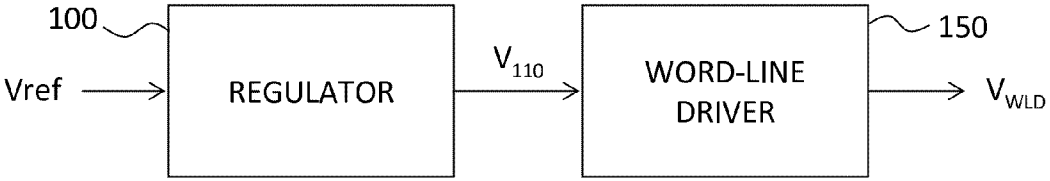
FIG. 5A is a block diagram of an example of a regulator configured to provide a regulated voltage to a word-line driver in accordance with some embodiments.
Figure 5B:
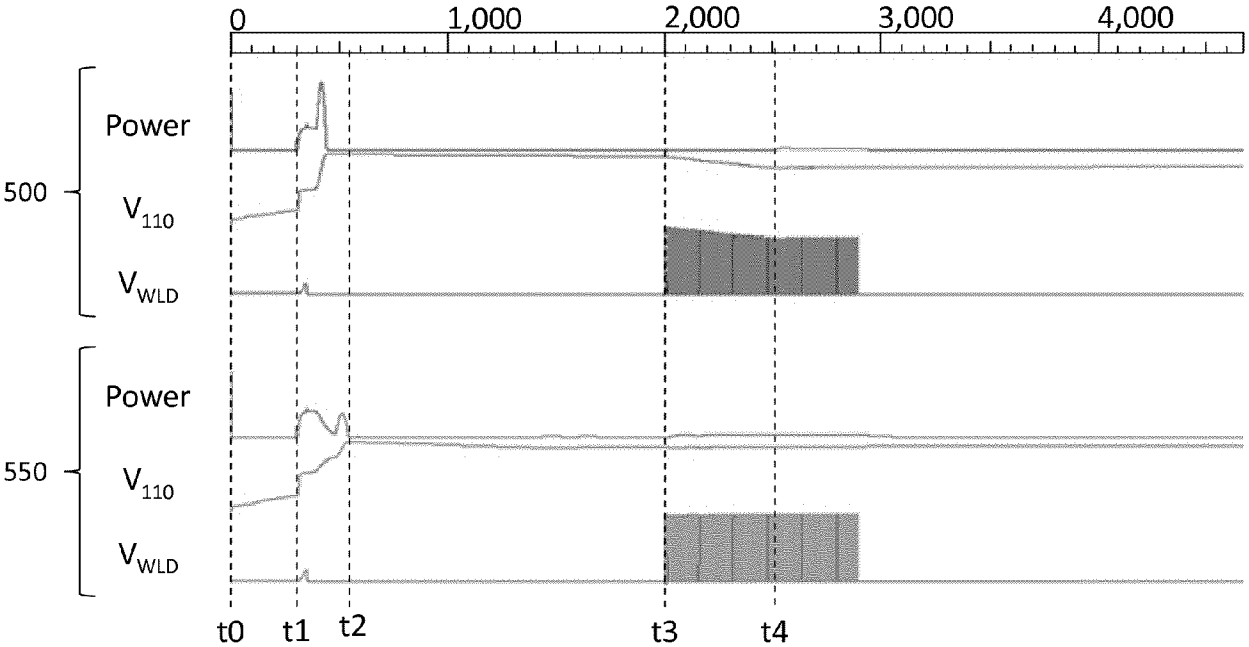
FIG. 5B is a timing diagram of various signals of a conventional regulator and word-line driver and a regulator in accordance with FIG. 1 powering a word-line driver during a start-up period.

For example and referring to FIG. 5A, a regulator in accordance with FIG. 1 was simulated as providing a regulated voltage, e.g., $V_{110}$, to a word-line driver 150, which outputs a word-line voltage, $V_{WLD}$, in response. FIG. 5B illustrates various signal traces of a conventional regulator that provides a regulated voltage to a word-line driver and the same traces of 100 regulator and word-line driver 150 in accordance with FIG. 5A. In FIG. 5B, traces 500 correspond to the signals of a conventional regulator and word-line driver, and traces 550 correspond to the signals of regulator 100 and word-line driver 150 illustrated in FIG. 5A.

As shown in FIG. 5B, the initial increase in the output voltage, $V_{110}$, of the conventional regulator and word-line driver is more rapid than the increase of the output voltage of regulator 100 and word-line driver 150 (comparing signals $V_{110}$ of 500 and 550 between t0 and t2). The more gradual increase provided by regulator 100 prevents the output voltage $V_{110}$ from overshooting its intended value and reduces the power consumed by regulator 100.

Additionally, preventing the overshooting of the intended value enables regulator 100 to settle at its intended voltage faster than the conventional voltage as can be seen by comparing the V110 traces between times t3 and t4. With the output voltage $V_{110}$ of regulator 100 settling to the desired voltage faster, i.e., waking up faster, the word-line driver 150 is able to output a steady voltage faster than a word-line driver driven by a conventional regulator as can be seen by comparing the $V_{WLD}$ signals between times t3 and t4.

One example of calculating of the value of high-impedance block 124 is described with reference to FIG. 2. In some embodiments, the constant current through high-impedance block 124, $I_{124}$, is set to be in accordance with the following parameter:

$$I_{124}<I_{108}-I_{112} \quad \text{Eq. (1)}$$

Where, $I_{108}$ is the supply current through transistor 108; and $I_{112}$ is the quiescent current through resistor string 112.

Meeting the parameter set forth in Equation 1 above prevents the voltage at node 110, $V_{110}$, from dropping too fast, which causes conventional devices to overshoot the target voltage and take longer to wake-up. In the embodiment illustrated in FIG. 2, the constant voltage $I_{124}$ is calculated as:

$$I_{124}=k(V_{gs132}-V_{t132})^2 \quad \text{Eq. (2)}$$

Where, k is a constant that depends on the manufacturing of transistor 132;

$V_{gs132}$ is the gate-source voltage of transistor 132, which is equal to Vbias; and $V_{t132}$ is the threshold voltage of transistor 132.

In view of the above, the impedance of high-impedance block 124 can be modeled as:

$$\frac{\partial I}{\partial V_{gs}} = 2k(V_{gs132} - V_{t132}) = \frac{1}{R_{132}}$$

Where, $R_{132}$ is the resistance of transistor 132.

Solving for the resistance of $R_{132}$ yields:

$$(V_{gs132} - V_{t132}) = \frac{1}{2kR_{132}} \quad \text{Eq. (3)}$$

$$R = \frac{1}{2k(V_{gs132} - V_{t132})} \quad \text{Eq. (4)}$$

Plugging in Equation 2 into Equation 1 provides $$k(V_{gs132} - V_{t132})^2 < I_{108} - I_{112} \quad \text{Eq. (5)}$$

Plugging Equation 3 into Equation 5 and solving for R yields:

$$\frac{1}{2}kR_{132}^2 < I_{108} - I_{112} \quad \text{Eq. (6)}$$

$$R_{132} > \frac{1}{2\sqrt{k(I_{108} - I_{112})}}$$

$$R_{132} < -\frac{1}{2\sqrt{k(I_{108} - I_{112})}} \quad \text{Eq. (7)}$$

Since the resistance, R132, must be positive, Equation 7 can be thrown out such that Equation 4 can be used to calculate the approximate value when the high-impedance range has been calculated by Equation 6. Calculating the value for high-impedance block 124 in accordance with the above advantageously provides for a constant current through high-impedance block 124 have reduced wake-up times and power consumption compared to conventional regulator circuits because the constant current reduces overshooting of the desired voltage. Additionally, the regulator circuit disclosed herein provide for reduced variations across all PVT corners.

In some embodiments, a regulating circuit includes a first comparator configured to control a turning on and a turning off of a first transistor based on a first comparison a reference voltage to a feedback voltage. The first transistor is coupled between an output node and a first voltage supply. A second comparator is configured to control a turning on and a turning off of a second transistor based on a second comparison of the reference voltage to the feedback voltage. The second transistor is coupled to the output node. A high-impedance circuit is coupled in series with the second transistor such that the high-impedance block is disposed between the second transistor and a second power supply. The high-impedance circuit is configured to generate a constant current between the output node and the second voltage supply when the second transistor is turned on.

In some embodiments, a method includes selectively coupling a first voltage supply to an output node in response to a first comparison of a reference voltage to a feedback voltage, selectively coupling the output node to a high-impedance circuit that is coupled to a second voltage supply node in response to a second comparison of the reference voltage to the feedback voltage, and outputting an voltage to the output node. The high-impedance circuit is configured to generate a constant current between the output node and the second voltage supply when coupled to the output node.

In some embodiments, a regulating circuit includes a first operational amplifier having a first input configured to receive a reference voltage and a second input configured to receive a feedback voltage. The first operational amplifier is configured to output a first voltage based on a difference between the reference voltage and the feedback voltage. A second operational amplifier has a first input configured to receive the reference voltage and a second input configured to receive the feedback voltage. The second operational amplifier is configured to output a second voltage based on a difference between the reference voltage and the feedback voltage. A first transistor has a source coupled to a first voltage supply, a drain coupled to an output node, and a gate configured to receive the first voltage from an output of the first operational amplifier. A second transistor has a drain coupled to the output node and a gate configured to receive the second voltage from an output of the second operational amplifier. A high-impedance circuit is coupled between a second voltage supply and a source of the second transistor. The first transistor is configured to be selectively turned on and turned off in response to the first voltage, the second transistor is configured to be selectively turned on and turned off in response to the second voltage, and the high-impedance circuit is configured to generate a constant current between the output node and the second voltage supply when the second transistor is turned on.

Although the circuits and methods have been described in terms of exemplary embodiments, they are not limited thereto. Rather, the appended claims should be construed broadly, to include other variants and embodiments of the circuits and methods, which may be made by those skilled in the art without departing from the scope and range of equivalents of the circuits and methods.

What is claimed is:

1. A regulating circuit, comprising:

a first comparator configured to control a turning on and a turning off of a first transistor based on a first comparison of a reference voltage to a feedback voltage, the first transistor coupled between an output node and a first voltage supply;

a second comparator configured to control a turning on and a turning off of a second transistor based on a second comparison of the reference voltage to the feedback voltage, the second transistor coupled to the output node;

a high-impedance circuit coupled in series with the second transistor such that the high-impedance circuit is disposed between the second transistor and a second power supply; and a voltage divider coupled between the output node and the second power supply node such that the voltage divider is disposed in parallel with the second transistor;

wherein the high-impedance circuit is configured to generate a constant current between the output node and the second voltage supply when the second transistor is turned on, and wherein the high-impedance circuit has an impedance, Z, that satisfies the following condition:

$$Z > \frac{1}{2\sqrt{k(I_1 - I_2)}}$$

wherein, k is a constant based on the manufacturing of the high-impedance circuit, $I_1$ is a current through the first transistor, and $I_2$ is a current through the voltage divider.

2. The regulating circuit of claim 1, wherein the voltage divider is configured to provide the feedback voltage to the first and second comparators.

3. The regulating circuit of claim 1, wherein the first comparator includes a first operational amplifier having a first input configured to receive the reference voltage and a second input coupled to a node disposed between a pair of resistors that are coupled between the output node and the second voltage supply.

4. The regulating circuit of claim 3, wherein the second comparator includes a second operational amplifier having a first input configured to receive the reference voltage and a second input coupled to the node disposed between the pair of resistors that are coupled between the output node and the second voltage supply.

5. The regulating circuit of claim 1, wherein the high-impedance circuit includes a resistor coupled to the source of the second transistor and to the second power supply.

6. The regulating circuit of claim 1, wherein the high-impedance circuit includes a third transistor having a source coupled to the second voltage supply, a drain coupled to a source of the second transistor, and a gate configured to receive a bias voltage.

7. A method, comprising:

selectively coupling a first voltage supply to an output node in response to a first comparison of a reference voltage to a feedback voltage, the first comparison of the reference voltage to the feedback voltage includes:

receiving the reference voltage at a first input of a first operational amplifier, receiving the feedback voltage at a second input of the first operational amplifier, and outputting a first voltage to a gate of a first transistor based on a difference between the reference voltage and the feedback voltage;

selectively coupling the output node to a high-impedance circuit that is coupled to a second voltage supply in response to a second comparison of the reference voltage to the feedback voltage, the second comparison of the reference voltage to the feedback voltage includes:

receiving the reference voltage at a first input of a second operational amplifier;

receiving the feedback voltage at a second input of the second operational amplifier;

dividing the output voltage at a voltage divider to generate the feedback voltage; and outputting a second voltage to a gate of a second transistor based on a difference between the reference voltage and the feedback voltage; and outputting a voltage to the output node, wherein the high-impedance circuit is configured to generate a constant current between the output node and the second voltage supply when coupled to the output node, wherein the high-impedance circuit has an impedance, Z, that satisfies the following condition:

$$Z > \frac{1}{2\sqrt{k(I_1 - I_2)}}$$

wherein, k is a constant based on the manufacturing of the high-impedance circuit, $I_1$ is a current through the first transistor, and $I_2$ is a current through the voltage divider.

8. The method of claim 7, wherein the voltage divider includes at least two resistors coupled between the output node and the second power supply such that the voltage divider is disposed in parallel with a transistor that selectively couples to the high-impedance circuit to the output node.

9. The method of claim 7, wherein the high-impedance circuit includes a resistor coupled to the second power supply and to a source of a transistor that selectively couples to the high-impedance circuit to the output node.

10. The method of claim 7, wherein the high-impedance block includes a transistor having a source coupled to the second voltage supply, a drain coupled to a source of a transistor that selectively couples to the high-impedance circuit to the output node, and a gate configured to receive a bias voltage.

11. A regulating circuit, comprising:

a first operational amplifier having a first input configured to receive a reference voltage and a second input configured to receive a feedback voltage, the first operational amplifier configured to output a first voltage based on a first difference between the reference voltage and the feedback voltage;

a second operational amplifier having a first input configured to receive the reference voltage and a second input configured to receive the feedback voltage, the second operational amplifier configured to output a second voltage based on a second difference between the reference voltage and the feedback voltage;

a first transistor having a source coupled to a first voltage supply node, a drain coupled to an output node, and a gate configured to receive the first voltage from an output of the first operational amplifier;

a second transistor having a drain coupled to the output node and a gate configured to receive the second voltage from an output of the second operational amplifier;

a high-impedance circuit coupled between a second voltage supply and a source of the second transistor; and a voltage divider coupled between the output node and the second voltage supply such that the voltage divider is disposed in parallel with the second transistor, wherein the first transistor is configured to be selectively turned on and turned off in response to the first voltage, the second transistor is configured to be selectively turned on and turned off in response to the second voltage, and the high-impedance circuit is configured to generate a constant current between the output node and the second voltage supply when the second transistor is turned on, and wherein the high-impedance circuit has an impedance, Z, that satisfies the following condition:

$$Z > \frac{1}{2\sqrt{k(I_1 - I_2)}}$$

wherein, k is a constant based on the manufacturing of the high-impedance circuit, $I_1$ is a current through the first transistor, and $I_2$ is a current through the voltage divider.

12. The regulating circuit of claim 11, wherein the voltage divider is configured to provide the feedback voltage to the first and second operational amplifiers.

13. The regulating circuit of claim 11, wherein the high-impedance circuit includes a resistor coupled to the source of the second transistor and to the second power supply.

14. The regulating circuit of claim 11, wherein the high-impedance circuit includes a third transistor having a source coupled to the second voltage supply node, a drain coupled to a source of the second transistor, and a gate configured to receive a bias voltage.

15. The regulating circuit of claim 11, further comprising an RC circuit coupled between the output node and the second voltage supply such that the RC circuit is disposed in parallel with the voltage divider and the second transistor.

* * * * *